US006056518A

United States Patent [19]

Allen et al.

[11] Patent Number: 6,056,518

[45] Date of Patent: May 2, 2000

[54] FLUID PUMP

[75] Inventors: David J. Allen, Gladstone; Brian K. Larche, Escanaba; Kenneth A. DeGrave, Wilson, all of Mich.

[73] Assignee: Engineered Machined Products, Escanaba, Mich.

[21] Appl. No.: 09/133,153

[22] Filed: Aug. 12, 1998

Related U.S. Application Data

[63] Continuation-in-part of application No. 08/876,833, Jun. 16, 1997, abandoned.

[51] Int. Cl.[7] ..... F04B 35/04

[52] U.S. Cl. ..... 417/355; 415/219.1; 415/244 R; 417/423.14; 417/423.7

[58] Field of Search ..... 417/355, 356, 417/423.7, 423.14; 415/219.1, 218.1, 211.2, 216.1, 244 R

[56] References Cited

U.S. PATENT DOCUMENTS

| | | | |
|---|---|---|---|
| 100,838 | 3/1870 | Andrews | 415/219.1 |
| 2,647,467 | 8/1953 | Davis | 415/219.1 |
| 2,868,133 | 1/1959 | Clark | 415/219.1 |
| 2,910,005 | 10/1959 | Angell et al. | 415/219.1 |
| 3,250,069 | 5/1966 | Rhoda | 415/219.1 |
| 3,398,694 | 8/1968 | Lerch | 415/219.1 |
| 4,063,849 | 12/1977 | Modianos | 415/210.1 |
| 4,876,492 | 10/1989 | Lester et al. | 318/254 |

*Primary Examiner*—Charles G. Freay
*Assistant Examiner*—Robert Z. Evora
*Attorney, Agent, or Firm*—Brooks & Kushman P.C.

[57] ABSTRACT

A fluid pump includes a housing having a passage therethrough with an inlet and an outlet. An impeller is positioned within the housing and includes an impeller axis, an inlet side and an outlet side. The impeller is axially supported only at the outlet side, and is configured to direct fluid at an acute angle relative to the impeller axis. A switched reluctance motor is secured to the housing for rotating the impeller for pumping fluid from the inlet to the outlet.

20 Claims, 9 Drawing Sheets

FLUID PUMP

CROSS-REFERENCE TO RELATED APPLICATION

This application is a Continuation-In-Part of U.S. patent application Ser. No. 08/876,833 filed Jun. 16, 1997, now abandoned.

TECHNICAL FIELD

The present invention relates to a fluid pump, and more particularly to a non-axle-driven fluid pump including an impeller which is axially supported only at its outlet side and driven by a switched reluctance motor.

BACKGROUND OF THE INVENTION

Typically, in engine cooling systems, a coolant pump comprises a pulley keyed to a shaft carrying a pump impeller which is driven by the engine via a belt and pulley coupling. Such pumps require fluid seals around the pump shaft which may present maintenance problems. Also, pump bearings are required, which often fail before other engine components. Failure of such components is sometimes due to the side load on bearings and seals from the belt and pulley drive, which tends to allow pressurized coolant to leak out of the system and cause bearing seizure.

These typical prior art pumps are also directly integrated with engine rpm via gears or pulleys, and thus flow rate is not controllable. Also, these pumps typically comprise low efficiency centrifugal impellers. They are also limited in where they can be mounted on the engine due to the requirement of connection to the engine drive.

U.S. Pat. No. 5,079,488 describes one attempt to overcome the shortcomings of prior art coolant pumps. The '488 patent provides an electronically commutated pump for pumping fluid in a vehicle coolant system which eliminates the need for fluid seals and eliminates non-symmetrical side loads. However, the invention described in the '488 patent is costly and inefficient in that it only provides flow rate in the range of five gallons per minute at 3000 rpm, and does not provide sufficient fluid pressure for engine coolant applications. The large impeller axle assembly of the '488 patent adds substantial cost to the product while significantly reducing fluid flow capacity, as well as pressure. Finally, the '488 patent uses magnets as part of the drive system which are expensive and degrade with heat and time.

Accordingly, it is desirable to provide an improved fluid pump which overcomes the above-referenced shortcomings of typical prior art mechanical pumps, while also providing enhanced fluid flow rate and control capability while reducing costs.

DISCLOSURE OF THE INVENTION

The present invention provides a fluid pump with an impeller which is axially supported only at the outlet side to avoid interference with fluid flow, thereby enhancing fluid flow performance. The impeller is rotatably driven by a switched reluctance motor secured to the housing for improved performance and controllability.

The design is self-lubricating and includes no bearings and the driven mechanism is independent of engine rpm, and therefore can directly control engine temperature. Non-symmetrical side loads on the pump are eliminated, and the pump is fully controllable by an engine computer and can be mounted anywhere in a coolant circuit. The design also provides efficiency and simplicity in a pump which requires as low as 50% less energy than typical prior art pump designs.

More specifically, the present invention provides a fluid pump including a housing having a passage therethrough with an inlet and an outlet, with an impeller positioned within the housing. The impeller includes an inlet side and an outlet side and has an impeller axis. The impeller is axially supported only at the outlet side and is configured to direct fluid at an acute angle relative to the impeller axis. A switched reluctance motor is secured to the housing for rotating the impeller for pumping fluid from the inlet to the outlet.

In a preferred embodiment, a diffuser is integral with the housing. The diffuser is configured to receive flowing fluid from the impeller and redirect the flowing fluid toward the outlet. A bushing (or bearing) is built into the diffuser for rotatably supporting a shaft which is secured to the outlet side of the impeller for supporting the impeller. A motor (stator and rotor) may also be built into the diffuser.

Accordingly, an object of the present invention is to provide a fluid pump which is driven by a switched reluctance motor for improved performance and controllability, and to eliminate magnets which tend to be expensive, heavy, and degrade quickly over time.

Another object of the invention is to provide a fluid pump having an impeller which is axially supported only at its outlet side for improved flow performance.

A further object of the invention is to provide a fluid pump with an impeller which directs fluid at an acute angle relative to the impeller axis, and a diffuser which redirects the flowing fluid toward a housing outlet.

Yet another object of the invention is to provide a fluid pump having a diffuser secured to the pump housing wherein the diffuser has a bushing built into the diffuser for axially supporting a rotatable impeller.

The above objects and other objects, features, and advantages of the present invention are readily apparent from the following detailed description of the best mode for carrying out the invention when taken in connection with the accompanying drawings.

DETAILED DESCRIPTION OF THE PREFERRED EMBODIMENT

Figure 1:
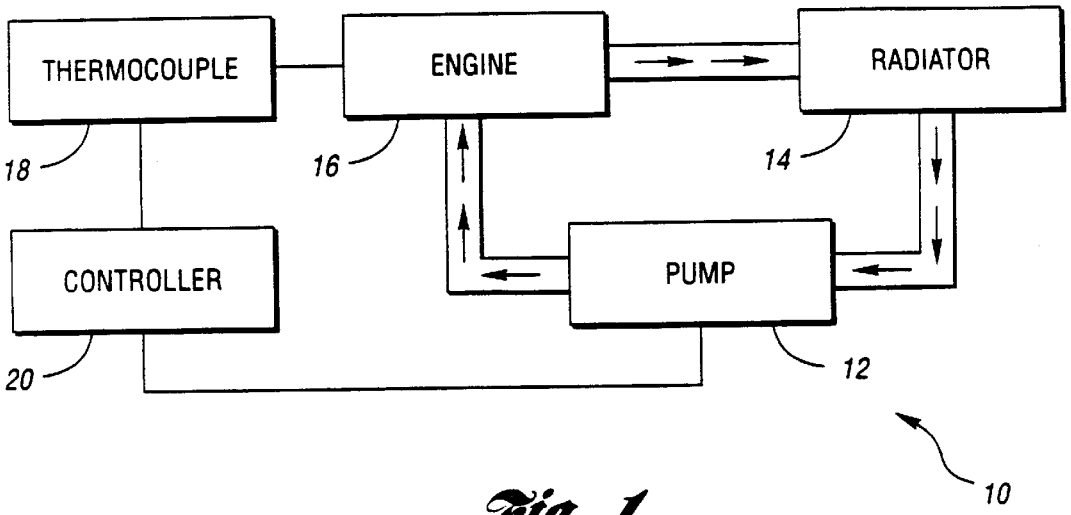
FIG. 1 shows a control schematic for a vehicle engine cooling system in accordance with the present invention.

FIG. 1 shows a control schematic for a vehicle engine coolant system 10 in accordance with the present invention. The system comprises a pump 12 which pumps cooled fluid from a radiator 14 through an engine 16 for cooling the engine. Thermocouples 18 are provided for sensing the engine and coolant temperature, and the sensed temperature information is provided to a controller 20, which electrically communicates with the pump 12 for controlling the flow rate and pressure generated by the pump 12 for distributing coolant to maintain desired engine temperatures. This controller can also be used in conjunction with the fan or thermostat to maintain a consistent and optimal engine temperature.

Figure 2:
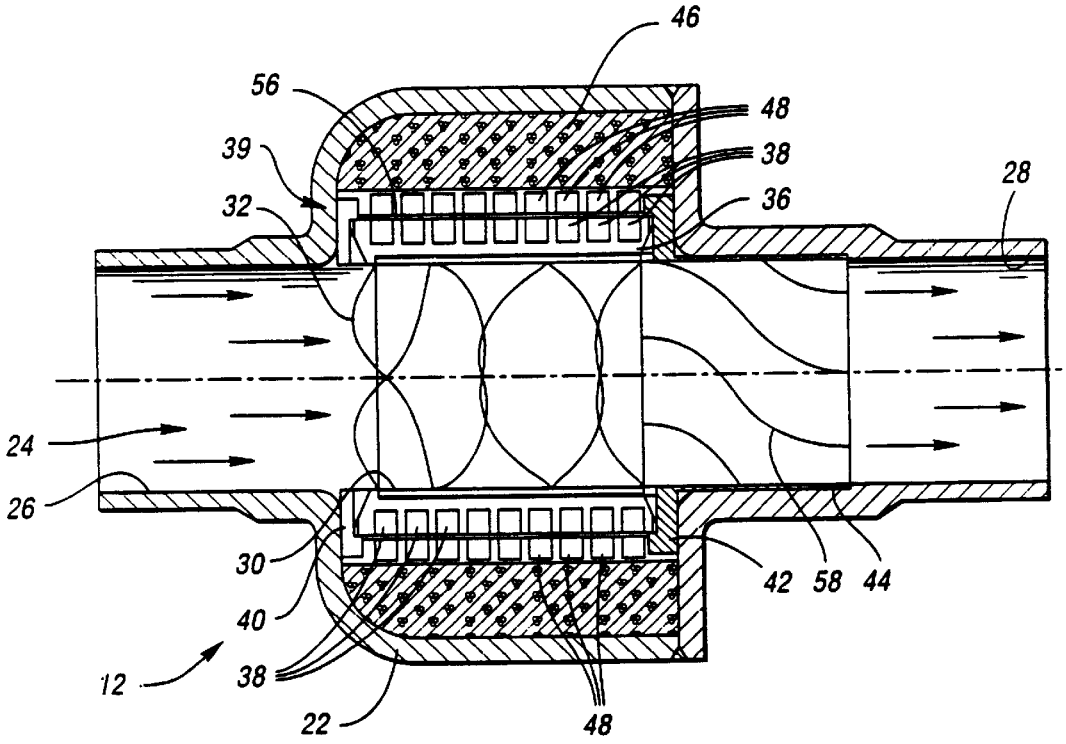
FIG. 2 shows a schematically arranged longitudinal cross-sectional view of an electromagnetically-actuated fluid pump in accordance with the present invention.

Referring to FIG. 2, a schematically-arranged longitudinal cross-sectional view of a pump 12 is shown in accordance with the present invention. The pump 12 includes a housing 22 having a continuous flow passage 24 formed therethrough. The passage 24 includes an inlet 26 and an outlet 28 adapted to be connected in the coolant system 10.

Figure 3:
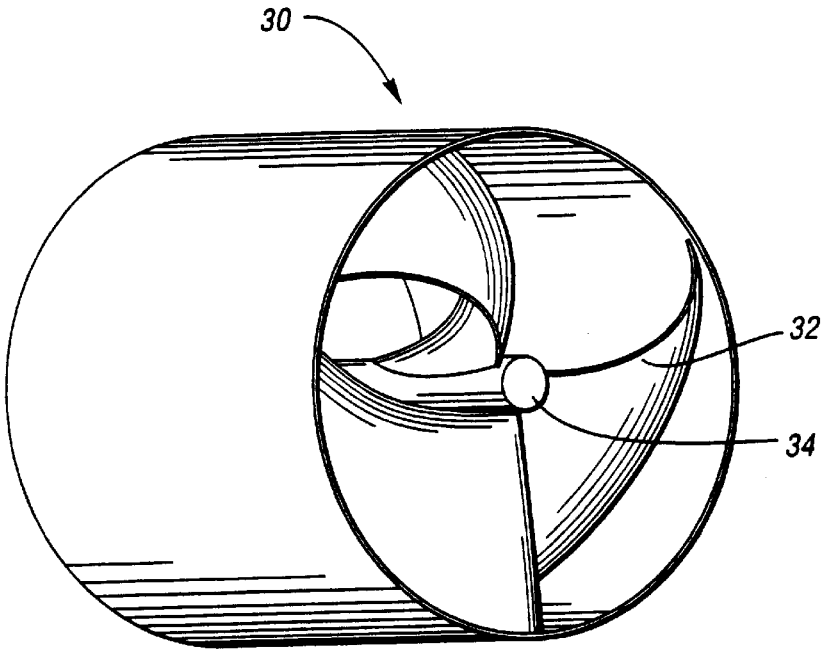
FIG. 3 shows a perspective view of an impeller for use with the pump shown in FIG. 2.
Figure 4:
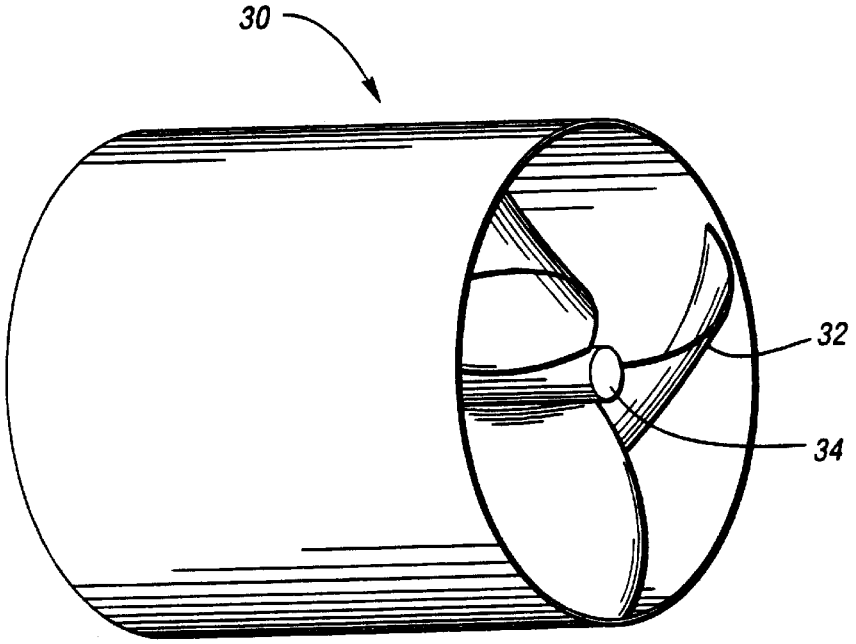
FIG. 4 shows a tilted perspective view of the impeller shown in FIG. 3.

A non-axle-driven impeller 30 is disposed within the passage 24, and is rotatable for moving fluid from the inlet 26 to the outlet 28. The impeller 30 includes a plurality of vanes 32, as more clearly shown in FIGS. 3 and 4. The vanes 32 comprise a specially-designed, twisted and curved shape, as shown, which enhances fluid flow capacity, as well as pressure. The impeller 30 comprises an axle 34, from which the vanes 32 extend, however, the impeller 30 is not axle-driven.

Returning to FIG. 2, the impeller 30 is secured to a floating rotatable rotor shell 36, which encompasses the impeller. The rotor shell includes a plurality of magnets 38 secured thereto. The floating rotatable rotor shell 36 is freely rotatable within a bushing assembly 39, which comprises a first bushing member 40, and a second bushing member 42, which is formed integrally as part of a diffuser 44, described below. The bushing assembly 39 preferably comprises carbon fiber, ceramic, brass, or bronze components. Of course, other materials could be used. No bearings are provided.

In order to rotate the impeller 30 and rotor shell 36, a stator coil assembly 46 is provided. The stator coil assembly 46 preferably comprises a DC brushless arrangement with 12 volt or 24 volt capacity. A plurality of pole pieces 48 are disposed within the coil assembly 46, such that the pole pieces 48 become magnetized and generate an electromagnetic field when the coil 46 is energized. The electromagnetic field generated by the coil 46 and pole pieces 48 acts upon the magnets 38 and the rotor shell 36 for inducing rotation of the rotor shell 36 and impeller 30. Accordingly, in this configuration, the impeller rpm can be directly controlled by the stator coils and system controller 20, thereby enabling greater engine temperature control by decoupling the pump from the engine rpm.

Figure 5:
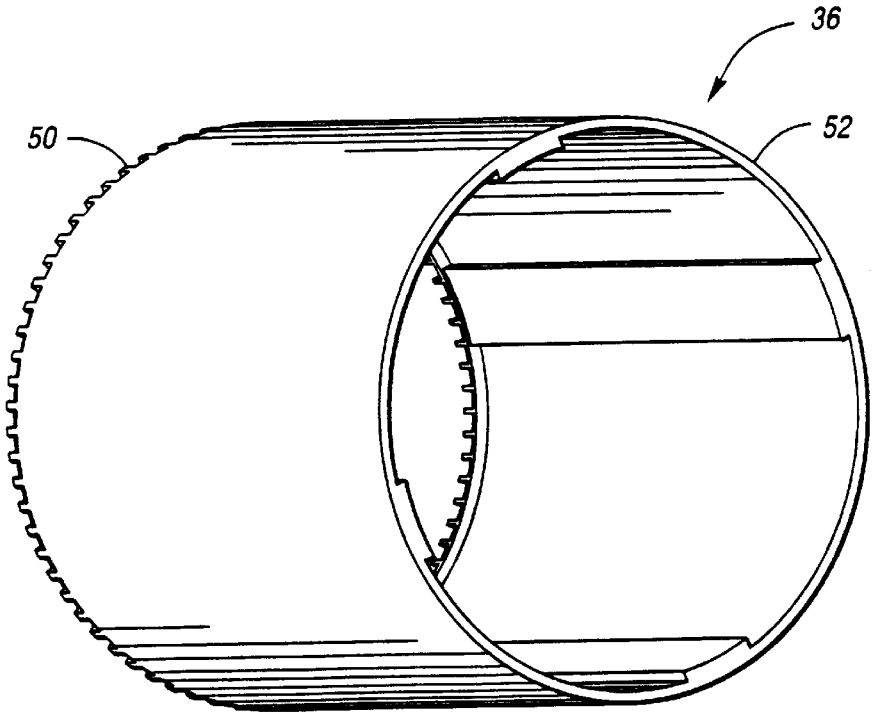
FIG. 5 shows a perspective view of a rotor shell for use with the pump shown in FIG. 2.
Figure 6:
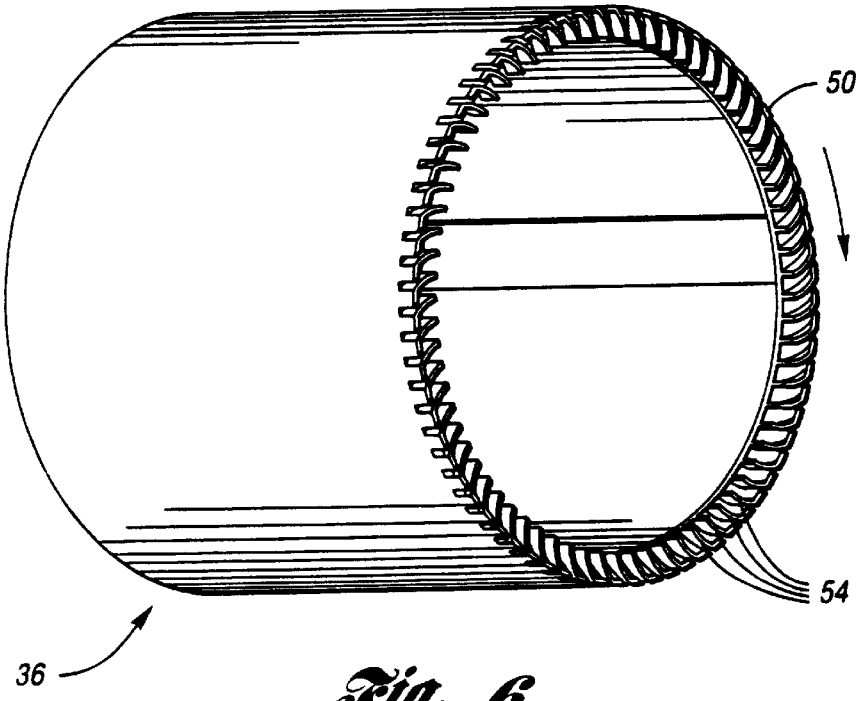
FIG. 6 shows a reverse perspective view of the rotor shell shown in FIG. 5.

As shown in FIGS. 5 and 6, the rotor shell 36 comprises first and second peripheral edges 50, 52, respectively. As more clearly shown in FIG. 6, the first peripheral edge 50 includes a plurality of fins 54 extending therefrom for directing fluid toward the first bushing member 40 for lubricating the first bushing member 40. The diverted fluid then flows along the outer surface 56 of the rotor shell 36 for drawing heat from the pole pieces 48 and coil 46 for cooling the coil 46. In this manner, the efficiency and longevity of the entire pump assembly is enhanced by efficiently cooling the coil assembly 46. Once the fluid has traveled the full length of the outer surface 56 of the rotor shell 36, it then flows past the second bushing member 42 for lubricating the second bushing member 42. In this manner, the rotor shell fins 54 redirect a portion of the fluid flow for lubricating the bushing assembly 39 and for dissipating heat from the coil 46.

The pump 12 is further provided with a diffuser 44 which includes a plurality of vanes 58 which help to laminarize turbulent flow generated in the impeller 30. The diffuser 44 also enhances pressure build up in the passage 24.

Accordingly, the seamless and bearingless flow-through fluid pump described above uses an electromagnetic stator field to rotate a specially-designed impeller with permanent magnets attached. This impeller, in conjunction with the diffuser 44, generates coolant flow and pressure requirements applicable to the diesel and gasoline engine industry. The design employs the special bushing assembly 39 described above to achieve long life in a harsh vehicle environment. This design is very simple in order to keep manufacturing costs down. The low number of moving parts enhances pump life, while the motor drive allows for controllability and engine design flexibility. This pump can also be used in other industries where the above features are desirable, such as chemical processing, the food industry, and other manufacturing applications.

Typical specifications for a pump as described herein for use with a vehicle engine would comprise an impeller with a two inch to four inch diameter. Pump speed would range from 0 to 5000 rpms, with a DC voltage of 12 volts or 24 volts. The pump would generate an output pressure of 0 to 30 psi and 0 to 110 gallons per minute. This output flow capacity is substantially greater than the axle-driven design described in U.S. Pat. No. 5,079,488, as discussed above. Horsepower provided is 0 to 1.

Figure 7:
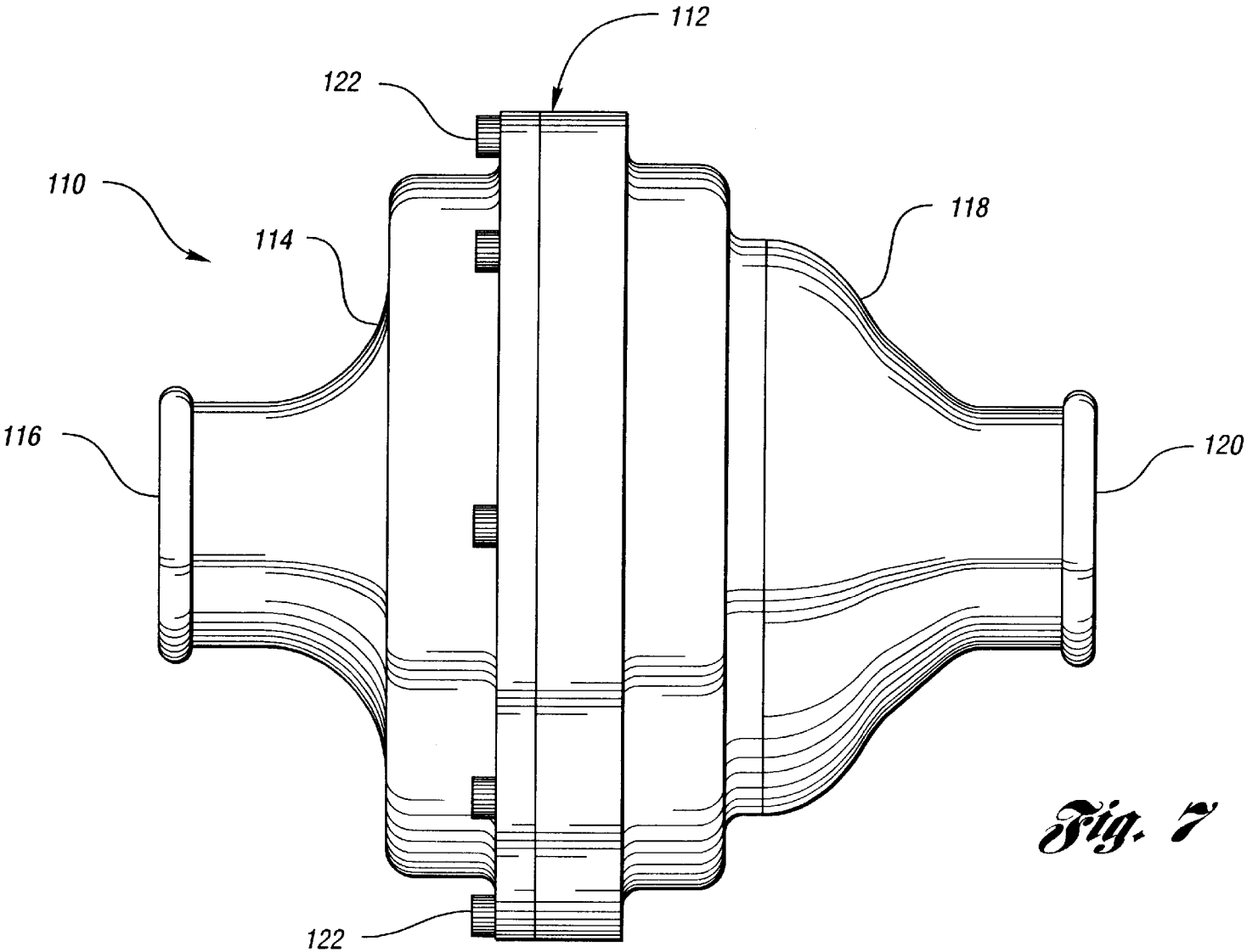
FIG. 7 shows a side view of a fluid pump in accordance with an alternative embodiment of the invention.
Figure 8:
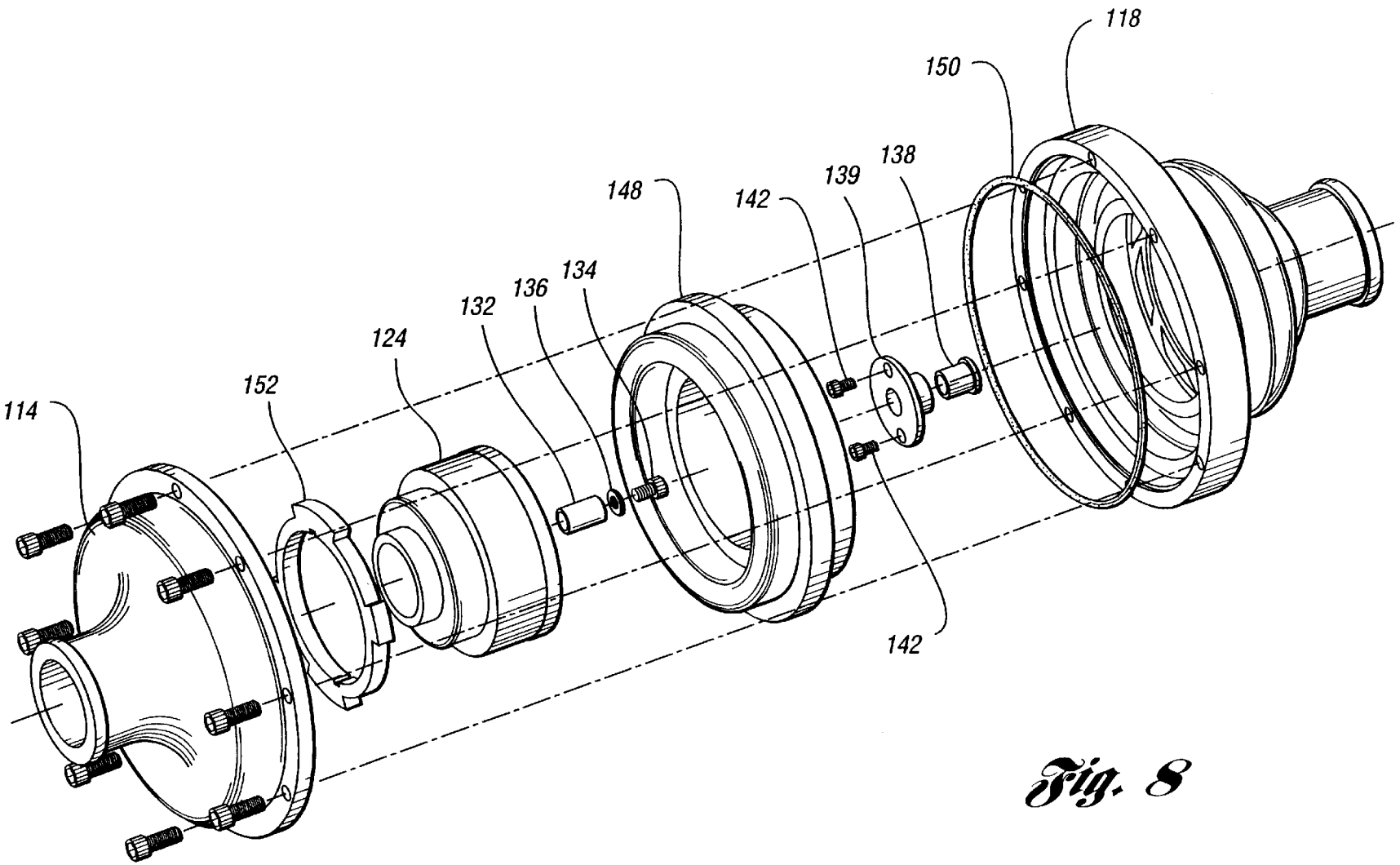
FIG. 8 shows an exploded perspective view of the fluid pump of FIG. 7.
Figure 9:
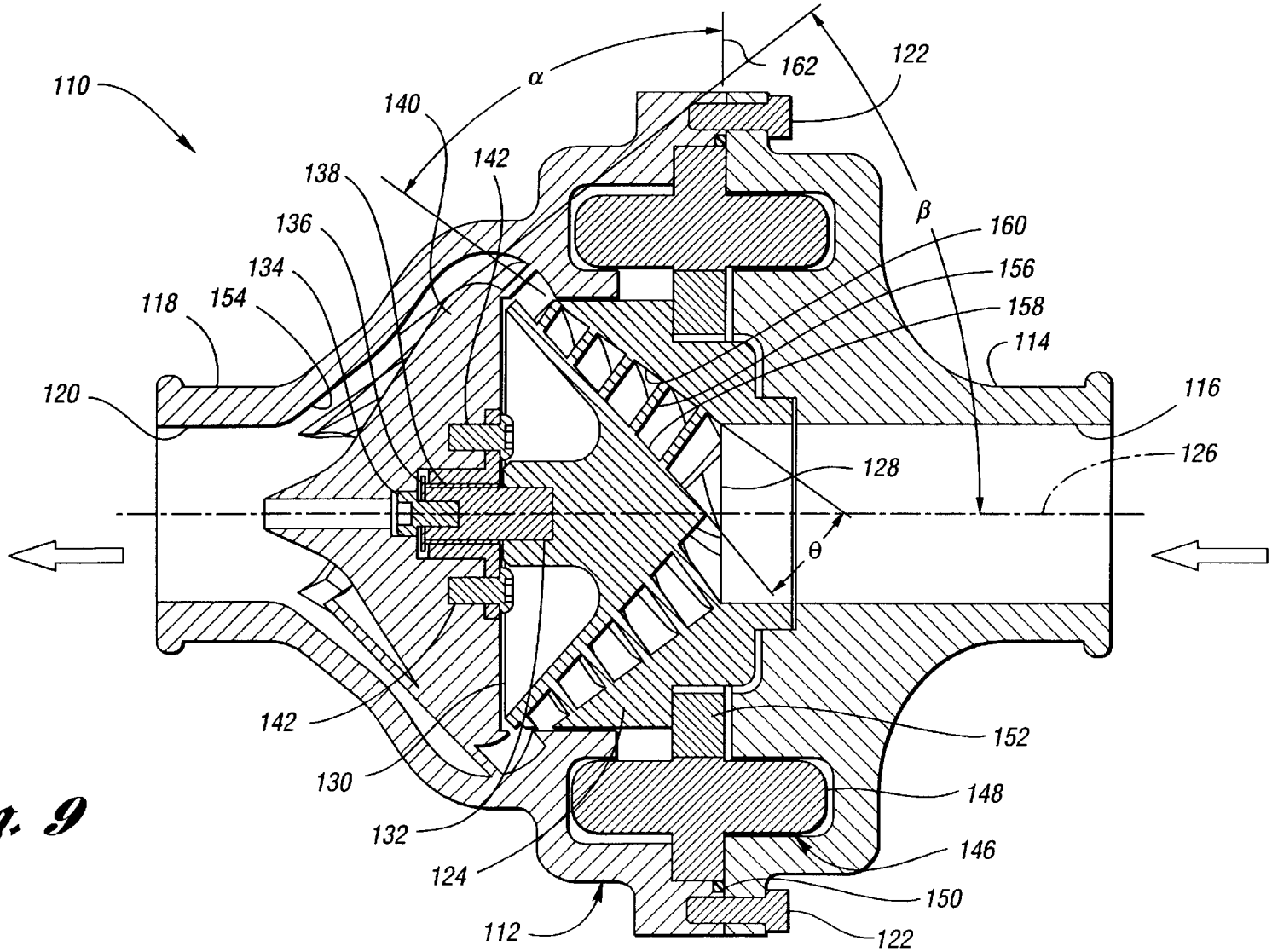
FIG. 9 shows a longitudinal cross-sectional view of the fluid pump of FIG. 7.

Referring to FIGS. 7–9, a fluid pump 110 is shown in accordance with an alternative embodiment of the invention. As shown in FIG. 7, the fluid pump 110 includes a housing 112 including an inlet housing 114 with a fluid inlet 116, and an outlet housing 118 with a fluid outlet 120. Bolts 122 secure the inlet housing 114 to the outlet housing 118.

As shown in FIGS. 8 and 9, an impeller 124 is rotatably positioned within the housing 112 for rotation about the impeller axis 126. The impeller 124 has an inlet side 128 and an outlet side 130. The impeller 124 is axially supported only at its outlet side 130 by the shaft 132. A bolt 134 and thrust washer 136 secure the shaft 132 to the bushing 138 for rotatably supporting the shaft 132 within the retainer 139, which is secured within the diffuser 140 by bolts 142. By rotatably supporting the bushing 138 within the diffuser 140, a substantial amount of space is saved in the overall assembly. In this configuration, the impeller 124 is supported axially only at its outlet side 130 by the shaft 132 and bushing 138.

The bushing 138 is preferably a self-lubricating brass bushing with built-in lubricating channels. Alternatively, the bushing could be carbon, graphite, ceramic, plastic, etc. Also, the bushing could be replaced by bearings of metal, plastic or ceramic.

A switched reluctance motor 146 is provided within the housing 112 for rotating the impeller 124 for pumping fluid from the inlet 116 to the outlet 120. The switched reluctance motor 146 includes a stator 148 which is rigidly secured to the housing 112 radially within the O-ring seal 150, and a rotor 152 which is rigidly secured to the impeller 124 for rotation therewith. The switched reluctance motor 146 is less expensive, simpler, and uses no magnets, which are heavy, costly, and tends to degrade quickly over time. The term "switched reluctance motor" is considered to include the following terminology: Variable reluctance motors, brushless reluctance motors, commutated reluctance motors, and electronically commutated motors. Switched reluctance motors operate on the principle of minimizing the reluctance along the path of the applied magnetic field. The switch reluctance motor is a doubly salient, singly excited motor. In other words, it has salient poles on both the rotor and the stator, but only the stator carries the windings. The rotor, being built from a stack of salient pole laminations, remains quite simple and rugged without permanent magnets or landings.

The basic design of a switched reluctance motor includes stator poles which are wound in pairs opposite each other. In this configuration, six stator poles will yield a three-phase motor, for example, and eight stator poles will yield a four-phase motor. The number of stator poles normally exceeds the number of rotor poles. A detailed description of switched reluctance motor technology may be found, for example, in "Electric Machinery and Transformers", Guru et al., pages 422–426, HARCOURT BRACE JOVANOVICH, INC., 1988.

Alternatively, the motor could be a magnetic based DC brushless motor, and the magnet could be ceramic, alnico, rare earth, etc.

The diffuser 140 is built into, or formed integrally with, the outlet housing 118. As shown in FIG. 9, the impeller 124 and diffuser 140 are conical in shape such that the impeller 124 directs fluid at an acute angle relative to the impeller axis 126, and the diffuser 140 in conjunction with the conical wall 154 of the outlet housing 118 redirects the flowing fluid toward the outlet 120. The impeller 124 includes a plurality of impeller blades 156 positioned between opposing impeller walls 158, 160, which are formed at an angle $\theta$ of approximately 12.5° with respect to each other. The outer wall 160 is positioned at an angle $\alpha$ of approximately 54° with respect to a plane 162 perpendicular to the impeller axis 126. The impeller 124 preferably is a six vane turbine-type flow-through pump. It is contemplated that three to nine vanes could be used, and a centrifugal vane could alternatively be employed.

The diffuser 140 preferably includes five straight vanes. Alternatively, the vanes could be curved, and three to eight vanes would typically be used. The bushing 132 is preferably built into the diffuser 140, but could alternatively be built into the housing 112.

The diffuser vane blades each comprise a diffuser outlet tangential angle which is parallel to the axis of rotation 126 so that fluid traveling through the outlet 120 is traveling substantially straight without a helical swirl.

The conical wall 154 of the housing 118 is arranged at an angle $\beta$ of approximately 38.3° with respect to the impeller axis 126 for redirecting fluid flow received from the impeller 124 toward the outlet in a direction parallel to the impeller axis 126. As fluid travels through the diffuser 140, the cross-sectional flow area between diffuser vanes increases so that pressure of the fluid is increased.

Figure 10:
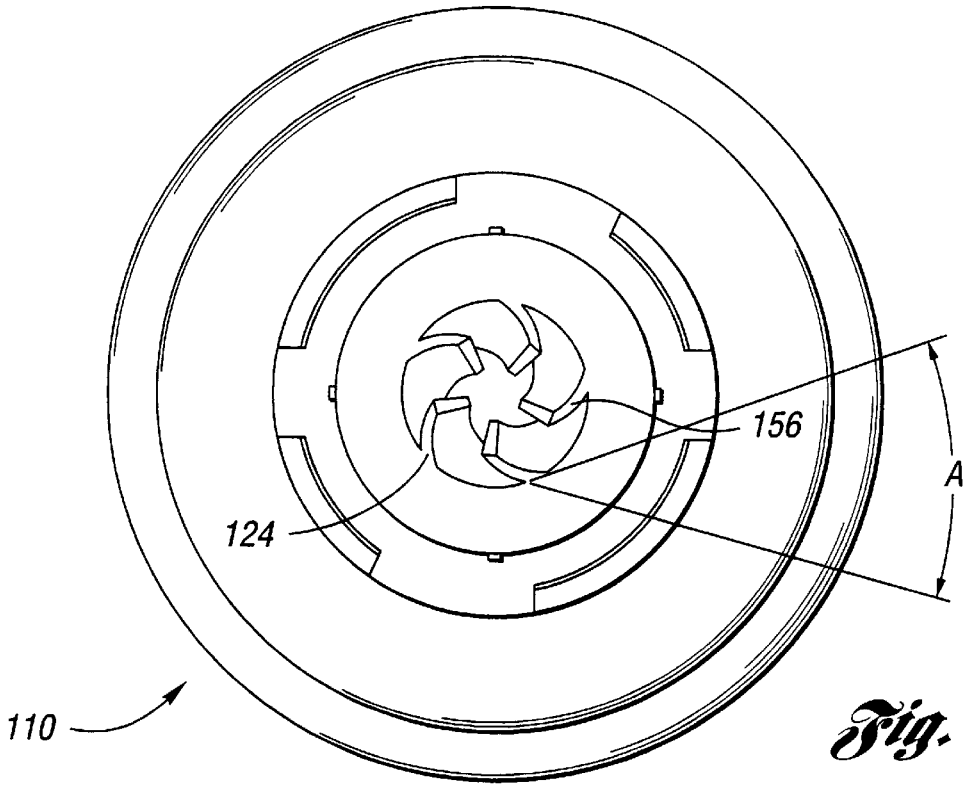
FIG. 10 shows a partially disassembled end view of the fluid pump of FIG. 7 illustrating the impeller inlet tangential angle.

As shown in FIG. 10, the impeller blades 156 are arranged to include an impeller inlet tangential A of approximately 35°.

Figure 11:
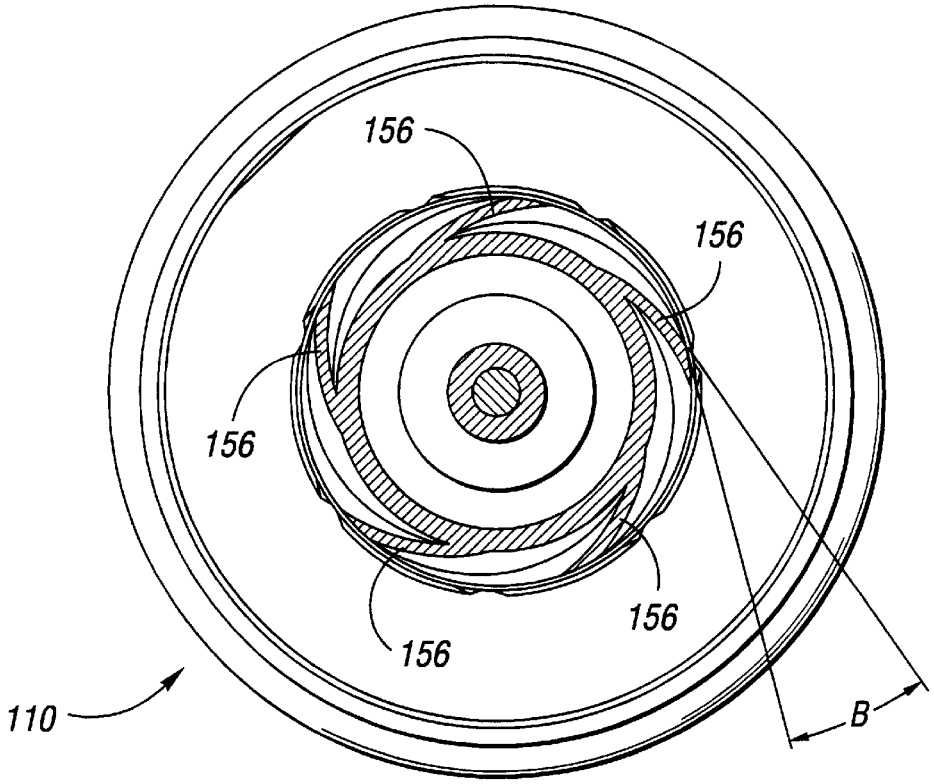
FIG. 11 shows an opposing partially disassembled end view of the fluid pump of FIG. 7 illustrating the impeller outlet tangential angle.

As shown in FIG. 11, the impeller vanes 156 are configured to include an impeller outlet tangential angle B of approximately 20°.

Figure 12:
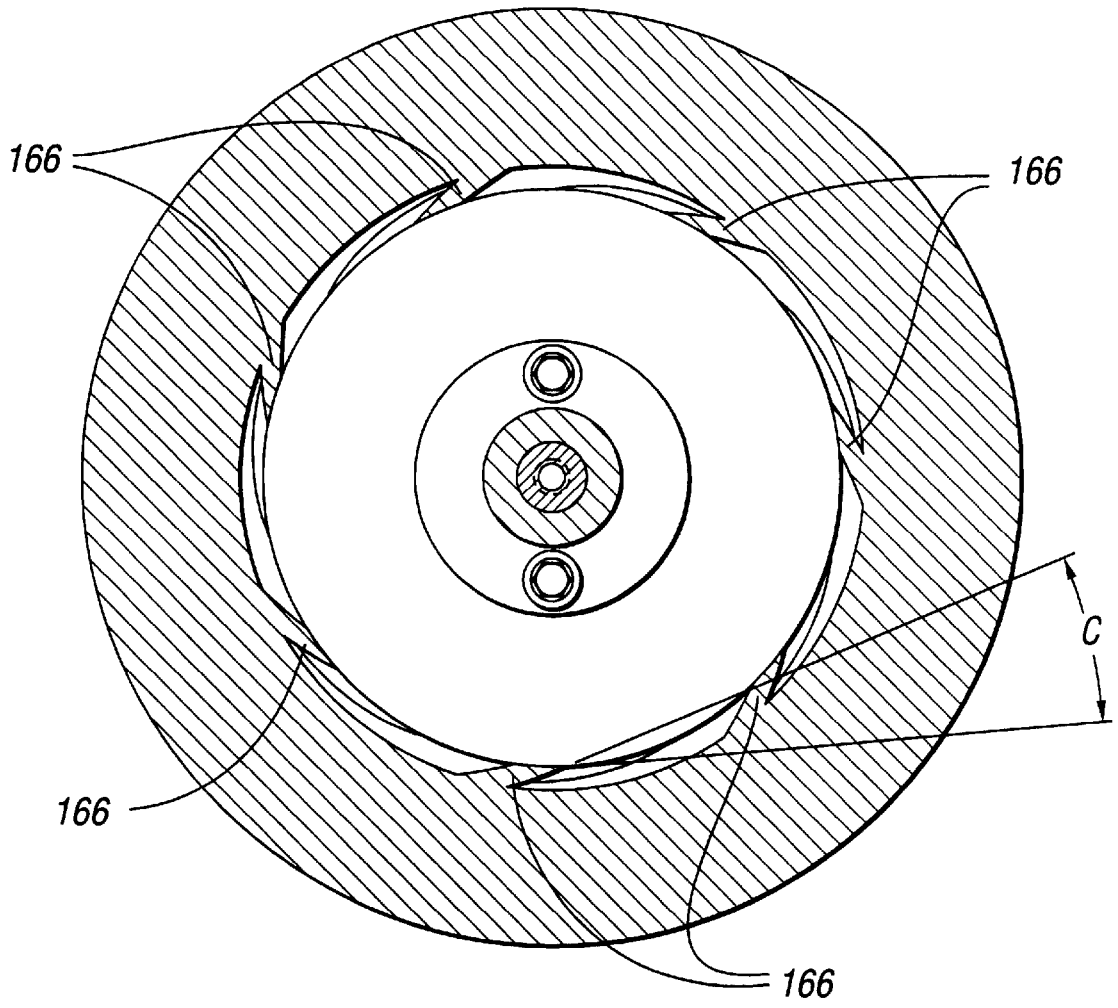
FIG. 12 shows an inlet end view of the diffuser corresponding with the embodiment of FIG. 7.

As shown in FIG. 12, the diffuser vanes 166 are configured to include a diffuser inlet tangential angle C of approximately 18°.

In a preferred embodiment for use in a vehicle engine, the impeller 124 would have a diameter of two to four inches, the pump speed would range from 0 to 7500 rpm, output pressure would range from 0 to 30 psi, output flow would range from 0 to 120 gpm, and DC voltage would be 12 or 24 volts.

Figure 13:
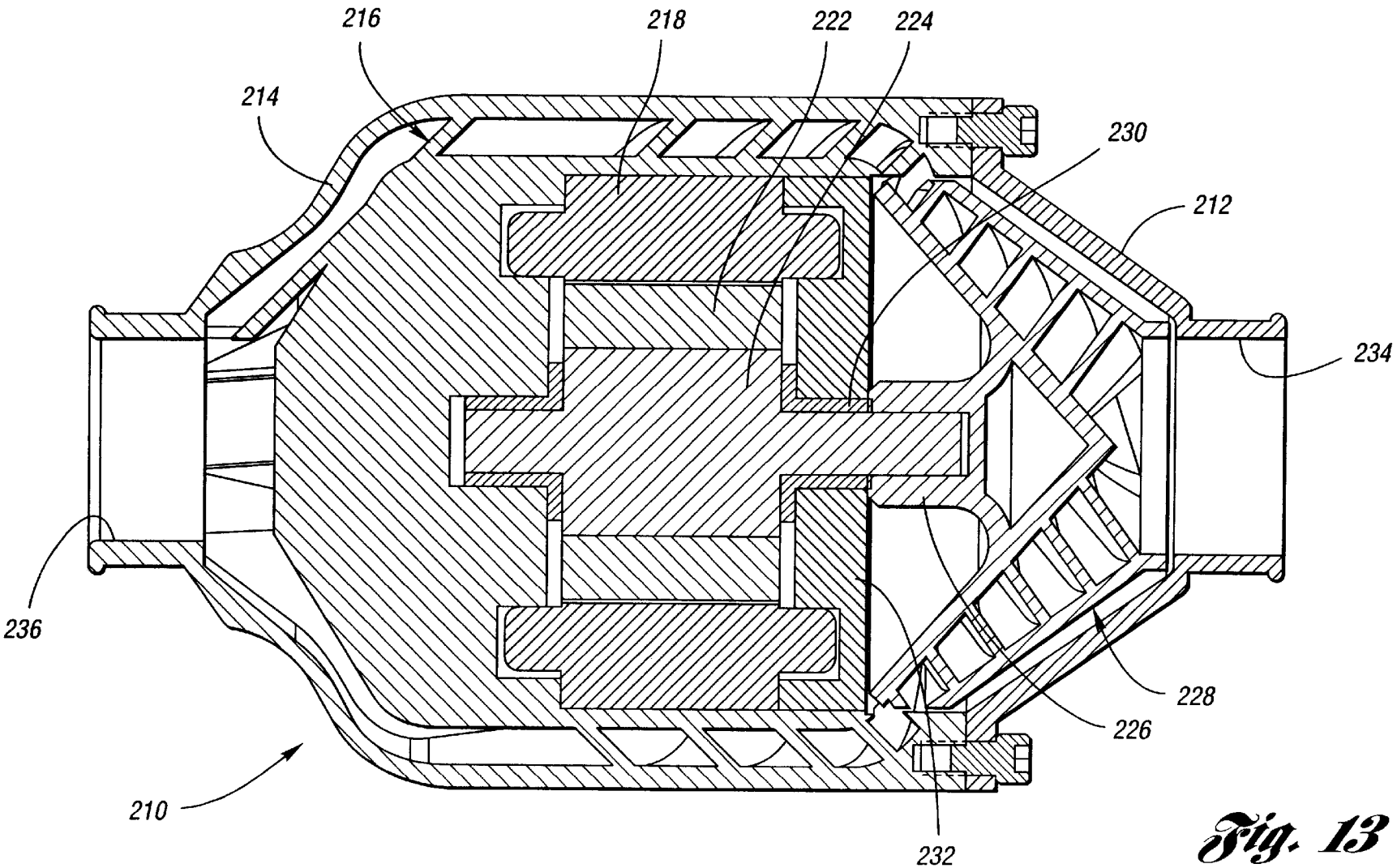
FIG. 13 shows a longitudinal cross-sectional view of a fluid pump in accordance with a second alternative embodiment of the invention.

Referring to FIG. 13, a fluid pump 10 is shown in accordance with a second alternative embodiment of the invention. The pump 210 includes an inlet housing 212 connected to an outlet housing 214 having a diffuser 216 formed integrally within the outlet housing 214. A diffuser 216 includes a stator 218 built into the diffuser 216. The stator 218 rotatably drives a rotor 222, which is connected to a rotatable shaft 224. The rotatable shaft 224 is connected to the outlet side 226 of the impeller 228 for rotatably supporting and driving the impeller 228. The shaft 224 is supported on the bearing 230, which is supported by the plate 232. Accordingly, energization of the stator 218 causes rotation of the rotor 222 and shaft 224 for rotating the impeller 228 for drawing fluid into the fluid inlet 234 in the inlet housing 212, through the diffuser 216, and out the outlet housing exit 236.

This configuration may be better suited for smaller engines. Also, another advantage of this design is that the inlet housing 212 and outlet housing 214 may be injection molded plastic, which will reduce manufacturing costs.

While the best modes for carrying out the invention have been described in detail, those familiar with the art to which this invention relates will recognize various alternative designs and embodiments for practicing the invention within the scope of the appended claims.

What is claimed is:

1. A fluid pump, comprising:

a housing having a passage therethrough with an inlet and an outlet;

an impeller positioned within the housing and having an impeller axis, an inlet side and an outlet side, said impeller being axially connected only at the outlet side, and said impeller being configured to direct fluid at an acute angle relative to said impeller axis; and a switched reluctance motor secured to the housing for rotating the impeller for pumping fluid from said inlet to said outlet.

2. The fluid pump of claim 1, wherein said switched reluctance motor comprises a rotor secured to the impeller, and a stator secured to the housing.

3. The fluid pump of claim 1, further comprising a shaft secured to said outlet side and a bushing rotatably supporting said shaft.

4. The fluid pump of claim 3, further comprising a diffuser secured to the housing and supporting said bushing, wherein said diffuser is configured to receive flowing fluid from said impeller and redirect the flowing fluid toward said outlet.

5. The fluid pump of claim 1, wherein said housing is configured to receive fluid from said impeller at said acute angle and to redirect said flowing fluid in a direction parallel to said impeller axis.

6. The fluid pump of claim 5, wherein said housing comprises a conical outlet surface arranged at an angle of at least 30° with respect to said impeller axis.

7. The fluid pump of claim 1, wherein said impeller comprises first and second substantially conical fluid-directing walls arranged at an angle of approximately 10° to 15° with respect to each other.

8. The fluid pump of claim 4, wherein said diffuser is integral with said housing.

9. The fluid pump of claim 1, further comprising a diffuser, and wherein said motor includes a stator built into said diffuser and a rotor-driven drive shaft connected to said outlet side.

10. A fluid pump, comprising:

a housing having a passage therethrough with an inlet and an outlet, an impeller positioned within the housing and having an impeller axis, an inlet side and an outlet side, said impeller being axially connected only at the outlet side, and said impeller being configured to direct fluid at an acute angle relative to said impeller axis; and a diffuser secured to the housing and configured to receive flowing fluid from said impeller and to redirect the flowing fluid toward said outlet, said diffuser including vane blades configured to redirect the flowing fluid substantially straight through the outlet without a helical swirl;

wherein said inlet and outlet are positioned coaxially alone the impeller axis.

11. The fluid pump of claim 10, further comprising a switched reluctance motor secured to the housing for rotating the impeller.

12. The fluid pump of claim 11, wherein said switched reluctance motor comprises a rotor secured to the impeller, and a stator secured to the housing.

13. The fluid pump of claim 10, further comprising a shaft secured to said outlet side and a bushing rotatably supporting said shaft.

14. The fluid pump of claim 10, wherein said housing is configured to receive fluid from said impeller at said acute angle and to redirect said flowing fluid in a direction parallel to said impeller axis.

15. The fluid pump of claim 14, wherein said housing comprises a conical surface arranged at an angle of at least 30° with respect to said impeller axis.

16. The fluid pump of claim 10, wherein said impeller comprises first and second substantially conical fluid-directing walls arranged at an angle of approximately 10° to 15° with respect to each other.

17. The fluid pump of claim 10, wherein said diffuser is integral with said housing.

18. The fluid pump of claim 10, further comprising a stator built into the diffuser and a rotor-driven drive shaft connected to said outlet side.

19. The fluid pump of claim 10, further comprising a magnetic motor secured to the housing for rotating the impeller.

20. A fluid pump, comprising:

a housing having a passage therethrough with an inlet and an outlet;

an impeller positioned within the housing and having an impeller axis, an inlet side and an outlet side, said impeller being axially connected only at the outlet side, and said impeller being configured to direct fluid at an acute angle relative to said impeller axis;

a switched reluctance motor secured to the housing for rotating the impeller for pumping fluid from said inlet to said outlet;

a diffuser formed integrally with the housing and configured to receive flowing fluid from said impeller and redirect the flowing fluid towards said outlet; and a bushing built into the diffuser for rotatably supporting said impeller at said outlet side.

* * * * *

UNITED STATES PATENT AND TRADEMARK OFFICE

CERTIFICATE OF CORRECTION

PATENT NO. : 6,056,518

DATED : May 2, 2000

INVENTOR(S) : David J. Allen, et. al.

It is certified that error appears in the above-indentified patent and that said Letters Patent is hereby corrected as shown below:

Column 7, Line 27, Claim 10: delete "alone" and insert --along--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*